US006306005B1

(12) United States Patent
Archer

(10) Patent No.: US 6,306,005 B1
(45) Date of Patent: Oct. 23, 2001

(54) BUST SUPPORT DEVICE

(76) Inventor: Mary Archer, 1421 Heritage Way, Oakville Ontario (CA), L6M 3C2

( * ) Notice: Subject to any disclaimer, the term of this patent is extended or adjusted under 35 U.S.C. 154(b) by 0 days.

(21) Appl. No.: 09/540,521

(22) Filed: Mar. 31, 2000

(51) Int. Cl.[7] ..... A41C 1/14
(52) U.S. Cl. ..... 450/47; 450/41
(58) Field of Search ..... 450/41, 46, 47, 450/49, 51, 52

(56) References Cited

U.S. PATENT DOCUMENTS

| | | | | |
|---|---|---|---|---|
| D. 35,666 | | 2/1902 | Wade . | |
| 3,252,460 | * | 5/1966 | Lances | 450/41 |
| 3,702,614 | | 11/1972 | Miller . | |
| 4,558,705 | | 12/1985 | O'Boyle et al. . | |
| 4,617,934 | | 10/1986 | Hittel . | |
| 5,472,366 | * | 12/1995 | Moore | 450/41 |
| 5,527,202 | | 6/1996 | Morgan et al. . | |
| 5,967,876 | * | 10/1999 | Kollmanthaler et al. | 450/41 |

* cited by examiner

*Primary Examiner*—Gloria M. Hale

(57) ABSTRACT

A bust support device for utilizing a support member which is removable from a bust supporting garment. The bust support device includes a bust support device. The device is mountable in a bust supporting article of apparel. The bust supporting article of apparel has a pair of cups. Each of the cups has a bottom edge. Each of a pair of sleeves is fixedly coupled to one of the bottom edges of the cups. The sleeves each have a first end and a second end. Each of the first ends of the sleeves has an opening therein. Each of a pair of support members is removably insertable in one of the sleeves. Each of the support members is elongate and has a first and second end. Each of the support members is generally arcuate.

9 Claims, 2 Drawing Sheets

FIG 3
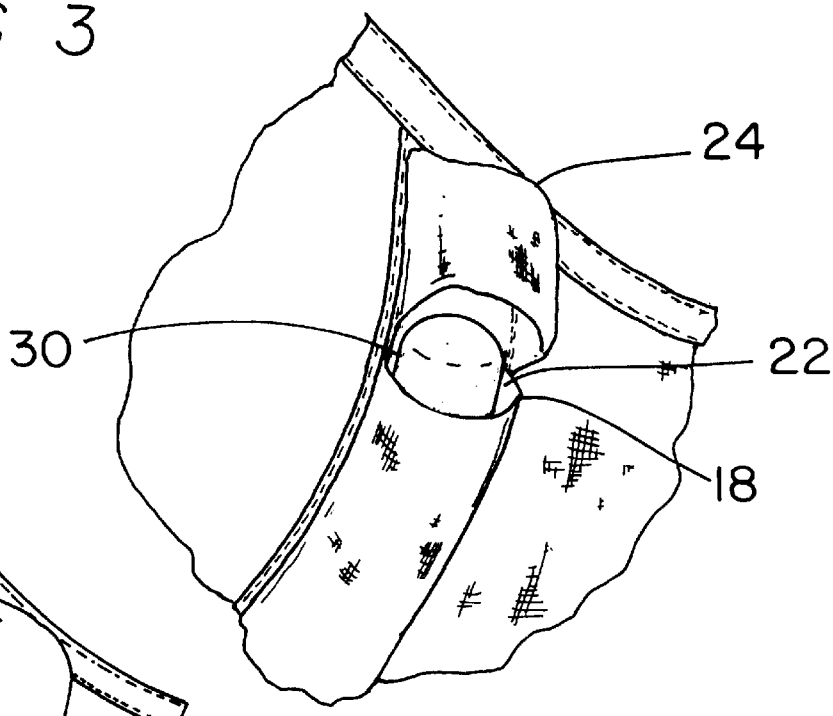
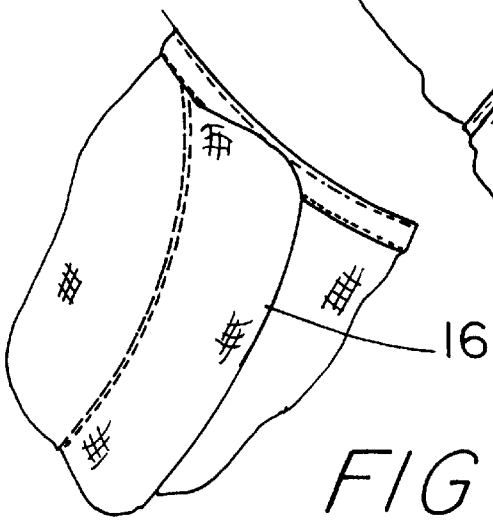
FIG 5
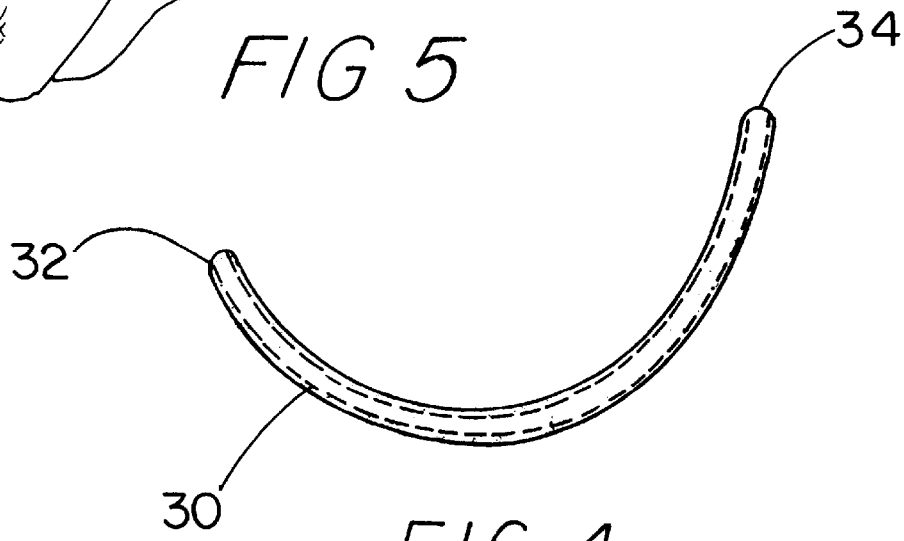
FIG 4

BUST SUPPORT DEVICE

BACKGROUND OF THE INVENTION

1. Field of the Invention

The present invention relates to braziers and more particularly pertains to a new bust support device for utilizing a support member which is removable from a bust supporting garment.

2. Description of the Prior Art

The use of braziers is known in the prior art. More specifically, braziers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,472,366; U.S. Pat. No. 4,558,705; U.S. Pat. No. 3,702,614; U.S. Pat. No. 5,527,202; U.S. Pat. No. 4,617,934; and U.S. Pat. No. 35,666.

While these devices fulfill their respective, particular objectives and requirements, the aforementioned patents do not disclose a new bust support device. The inventive device includes a bust support device. The device is mountable in a bust supporting article of apparel. The bust supporting article of apparel has a pair of cups. Each of the cups has a bottom edge. Each of a pair of sleeves is fixedly coupled to one of the bottom edges of the cups. The sleeves each have a first end and a second end. Each of the first ends of the sleeves has an opening therein. Each of a pair of support members is removably insertable in one of the sleeves. Each of the support members is elongate and has a first and second end. Each of the support members is generally arcuate.

In these respects, the bust support device according to the present invention substantially departs from the conventional concepts and designs of the prior art, and in so doing provides an apparatus primarily developed for the purpose of utilizing a support member which is removable from a bust supporting garment.

SUMMARY OF THE INVENTION

In view of the foregoing disadvantages inherent in the known types of braziers now present in the prior art, the present invention provides a new bust support device construction wherein the same can be utilized for utilizing a support member which is removable from a bust supporting garment.

The general purpose of the present invention, which will be described subsequently in greater detail, is to provide a new bust support device apparatus and method which has many of the advantages of the braziers mentioned heretofore and many novel features that result in a new bust support device which is not anticipated, rendered obvious, suggested, or even implied by any of the prior art braziers, either alone or in any combination thereof.

To attain this, the present invention generally comprises a bust support device. The device is mountable in a bust supporting article of apparel. The bust supporting article of apparel has a pair of cups. Each of the cups has a bottom edge. Each of a pair of sleeves is fixedly coupled to one of the bottom edges of the cups. The sleeves each have a first end and a second end. Each of the first ends of the sleeves has an opening therein. Each of a pair of support members is removably insertable in one of the sleeves. Each of the support members is elongate and has a first and second end. Each of the support members is generally arcuate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bust support device apparatus and method which has many of the advantages of the braziers mentioned heretofore and many novel features that result in a new bust support device which is not anticipated, rendered obvious, suggested, or even implied by any of the prior art braziers, either alone or in any combination thereof.

It is another object of the present invention to provide a new bust support device which may be easily and efficiently manufactured and marketed.

It is a further object of the present invention to provide a new bust support device which is of a durable and reliable construction.

An even further object of the present invention is to provide a new bust support device which is susceptible of a low cost of manufacture with regard to both materials and labor, and which accordingly is then susceptible of low prices of sale to the consuming public, thereby making such bust support device economically available to the buying public.

Still yet another object of the present invention is to provide a new bust support device which provides in the apparatuses and methods of the prior art some of the advantages thereof, while simultaneously overcoming some of the disadvantages normally associated therewith.

Still another object of the present invention is to provide a new bust support device for utilizing a support member which is removable from a bust supporting garment.

Yet another object of the present invention is to provide a new bust support device which includes a bust support device. The device is mountable in a bust supporting article of apparel. The bust supporting article of apparel has a pair of cups. Each of the cups has a bottom edge. Each of a pair of sleeves is fixedly coupled to one of the bottom edges of the cups. The sleeves each have a first end and a second end. Each of the first ends of the sleeves has an opening therein. Each of a pair of support members is removably insertable in one of the sleeves. Each of the support members is elongate and has a first and second end. Each of the support members is generally arcuate.

Still yet another object of the present invention is to provide a new bust support device that uses a support member having rounded, convex ends for the comfort of the wearer.

Even still another object of the present invention is to provide a new bust support device that has coverings for enclosing the open ends of the sleeves.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic perspective view of a covering member of the present invention.

FIG. 4 is a schematic perspective view of the end of a sleeve of the present invention.

FIG. 5 is a schematic side view of a supporting member of the present invention.

DESCRIPTION OF THE PREFERRED EMBODIMENT

Figure 1:
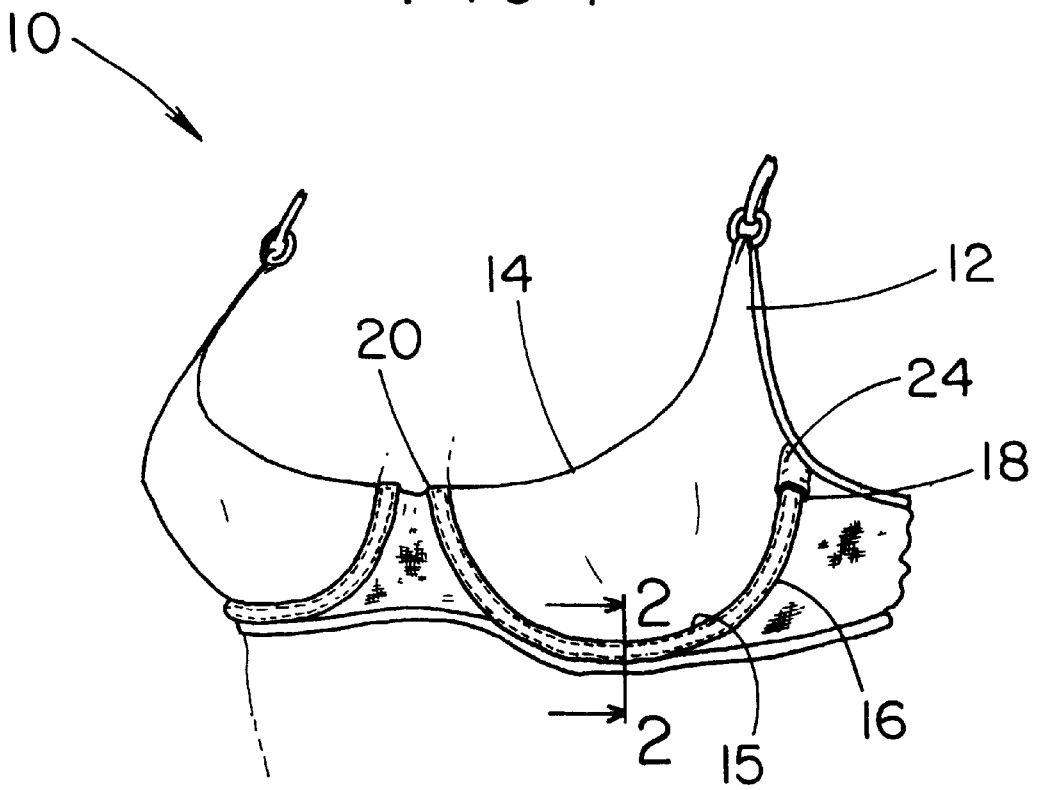
FIG. 1 is a schematic perspective view of a new bust support device according to the present invention.
Figure 2:
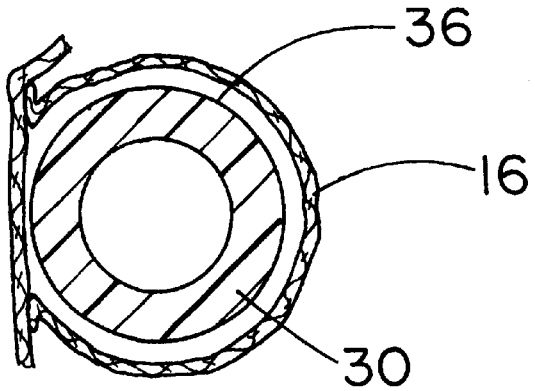
FIG. 2 is a schematic cross-sectional view taken along line 2—2 of the present invention.

With reference now to the drawings, and in particular to FIGS. 1 through 5 thereof, a new bust support device embodying the principles and concepts of the present invention and generally designated by the reference numeral 10 will be described.

As best illustrated in FIGS. 1 through 5. The bust support device 10 generally comprises a bust supporting article of apparel 12. The bust supporting article of apparel 12 has a pair of cups 14. Each of the cups 14 has a bottom edge 15. Each of the cups 14 has a sleeve 16 fixedly coupled to the bottom edge 15 of the cup 14. The sleeves 16 have a first end 18 and a second end 20. The first end 18 of the sleeve 16 has an opening therein 22.

A covering member 24 removably covers the openings 22 of the sleeves 16. The covering member 24 is positioned generally adjacent to the first end 18 of the sleeve 16. The covering member 24 is comprised of a cloth.

The cups 14 are comprised of cloth. The cloth is preferably selected from the group consisting of cotton, silk, synthetic cloth, and cotton-silk blend A pair of support members 30 are insertable in one of the sleeves 16. The support members 30 may be removably inserted within the sleeves or another embodiment may include wherein the sleeves are sewn closed such that the support members may not be removed. If the sleeves 16 have closed ends, the covering member 24 would not be needed. Each of the support members 30 is elongate and has a first 32 and second 34 end. The support members 30 are generally arcuate. The support members 30 are resiliently flexible and comprised of a plastic. The first 32 and second 34 ends of the support members 30 are preferably convex. A peripheral wall 36 of the support members extends between the first 32 and second 34 ends. The peripheral walls 36 have a generally circular cross-section. The support members 30 are generally hollow and have a diameter length generally less than one-half inch. The support member 30 retains the arcuate shape when inserted in the sleeve 16 and supporting a body portion of a user.

In use, the support members 30 help support the bust of a user. The convex ends 32, 34 of the support members 30 prevent the user from being poked, jabbed or otherwise inconvenienced by the support members 30. The support members 30 are also made from a resiliently flexible plastic, which is more comfortable for the wearer than braziers that utilize metal supporting devices. The sleeves 16 have an opening 22 for removal of the support members such that the supporting article of apparel 12 may be washed without warping or harming the support members 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bust support device mountable in a bust supporting article of apparel having a pair of cups, each of said cups having a bottom edge, said device comprising:

a pair of sleeves, each of said sleeves being fixedly coupled to one of the bottom edges of the cups, said sleeves each having a first end and a second end, each of said first ends of said sleeves having an opening therein;

a pair of support members, each of said support members being removably insertable in one of said sleeves, each of said support members being elongate and having a first and second end, each of said support members being generally arcuate; and wherein each of said support members being generally hollow.

2. The bust support device as in claim 1, further comprising:

a pair of covering members, each of said pair of covering members removably covering one of said openings in said sleeves, each of said covering members being positioned generally adjacent to one of said first ends of said sleeve.

3. The bust support device as in claim 1, wherein each of said support members comprises:

each of said first and second ends of said support members being generally convex.

4. The bust support device as in claim 3, wherein each of said support members includes a peripheral wall extending between said first and second ends, each of said peripheral walls having a generally circular cross-section.

5. A bust support device being mountable in a bust supporting article of apparel having a pair of cups, each of said cups having a bottom edge, said device comprising:

a pair of sleeves, each of said sleeves being fixedly coupled to one of the bottom edges of the cups, said sleeves each having a first end and a second end, each of said first ends of said sleeves having an opening therein;

a pair of support members, each of said support members being removably insertable in one of said sleeves, each of said support members being elongate and having a first and second end, each of said support members being generally arcuate;

a pair of covering members, each of said pair of covering members removably covering one of said openings in said sleeves, each of said covering members being positioned generally adjacent to one of said first ends of said sleeve;

each of said first and second ends of said support members being generally convex;

wherein a peripheral wall of each of said support members extends between said first and second ends, each of said peripheral walls having a generally circular cross-section; and wherein each of said support members is generally hollow.

6. The bust support device as in claim 5, wherein each of said support members having a diameter length generally less than one-half inch.

7. A bust support system, said system comprising:

a bust supporting article of apparel, said bust supporting article of apparel having a pair of cups, each of said cups having a bottom edge, each of said cups comprising:

a sleeve being fixedly coupled to said bottom edge of said cup, said sleeves having a first end and a second end, said first end of said sleeve having an opening therein;

a covering member for removably covering said opening of said sleeve, said covering member being positioned generally adjacent to said first end of said sleeve, said covering member being comprised of a cloth;

said cup being comprised of a cloth, said cloth being selected from the group consisting of cotton, silk, synthetic cloth, and cotton-silk blend; and a pair of support members for removably inserting in one of said sleeves, each of said support members comprising:

said support member being elongate and having a first and second end, said support member being generally arcuate, said support member being resiliently flexible and comprising a plastic, said first and second ends of said support member being generally convex, a peripheral wall of said support member extending between said first and second ends, said peripheral wall having a generally circular cross-section, said support member being generally hollow, said support member having a diameter length generally less than one-half inch, said support member retaining said arcuate shape when inserted in said sleeve and supporting a body portion of a user.

8. The bust support device as in claim 1, wherein said first and second ends of said sleeves are closed.

9. The bust support device as in claim 5, wherein said first and second ends of said sleeves are closed.

* * * * *